US009833017B2

(12) United States Patent
Sebastian

(10) Patent No.: US 9,833,017 B2
(45) Date of Patent: Dec. 5, 2017

(54) MIXED FIBER SLIVER FOR USE IN THE MANUFACTURE OF CIGARETTE FILTER ELEMENTS

(71) Applicant: R.J. Reynolds Tobacco Company, Winston-Salem, NC (US)

(72) Inventor: Andries Don Sebastian, Clemmons, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 54 days.

(21) Appl. No.: 14/924,203

(22) Filed: Oct. 27, 2015

(65) Prior Publication Data

US 2016/0044958 A1 Feb. 18, 2016

Related U.S. Application Data

(63) Continuation of application No. 13/557,473, filed on Jul. 25, 2012, now Pat. No. 9,179,709.

(51) Int. Cl.
*A24D 3/06* (2006.01)
*A24D 3/02* (2006.01)
(Continued)

(52) U.S. Cl.
CPC ..... *A24D 3/068* (2013.01); *A24D 3/0204* (2013.01); *A24D 3/0212* (2013.01); *A24D 3/063* (2013.01);
(Continued)

(58) Field of Classification Search
USPC ..... 131/331, 332, 200, 202, 341, 343, 345; 19/236, 145.5, 145.7; 493/39, 47, 49, 50
See application file for complete search history.

(56) References Cited

U.S. PATENT DOCUMENTS 2,175,107 A 10/1939 Casablancas
2,728,112 A 12/1955 Berker
(Continued)

FOREIGN PATENT DOCUMENTS

DE 4013293 A1 * 11/1991
EP 0 701 805 3/1996
(Continued)

OTHER PUBLICATIONS

Machine translation of DE 4013293, European Patent Office, [online], retrieved from the Internet, [retrieved Jul. 24, 2017], URL:https://worldwide.espacenet.com/?locale=EN_ep.*
(Continued)

*Primary Examiner* — Dennis Cordray
(74) *Attorney, Agent, or Firm* — Womble Carlyle Sandridge & Rice, LLP

(57) ABSTRACT

Smoking articles including filter elements formed from two or more fibrous inputs with different physical properties are provided. The two or more fibrous inputs are provided in the form of staple fibers, which are at least partially entangled with each other to form a mixed fiber sliver. The mixed fiber sliver includes a first plurality of cellulose acetate staple fibers blended with a second plurality of staple fibers comprising a polymeric material different from the first plurality of staple fibers, such as staple fibers of a degradable polymeric material. The entangled fibers of the mixed fiber sliver may be sufficiently separated from one another such that blooming operations typically required in filter element production may not be necessary prior to incorporating the mixed fiber sliver into a filter element. Related methods, apparatuses and mixed fiber products are also provided by the disclosure.

15 Claims, 2 Drawing Sheets

(51) Int. Cl.

| | |
|---|---|
| ***D02G 1/00*** | (2006.01) |
| ***D01G 13/00*** | (2006.01) |
| ***D01H 5/00*** | (2006.01) |
| ***A24D 3/10*** | (2006.01) |
| ***A24D 3/14*** | (2006.01) |

(52) U.S. Cl.
CPC ..... *A24D 3/10* (2013.01); *A24D 3/14* (2013.01); *D01G 13/00* (2013.01); *D01H 5/00* (2013.01); *D02G 1/00* (2013.01)

(56) References Cited

U.S. PATENT DOCUMENTS

| | | | | |
|---|---|---|---|---|
| 2,936,495 | A | | 5/1960 | Taine et al. |
| 3,119,396 | A | | 1/1964 | Tanquary |
| 3,224,453 | A | | 12/1965 | Mahoney et al. |
| 3,249,967 | A | | 5/1966 | Varga |
| 3,319,629 | A | | 5/1967 | Chamberlain |
| 3,353,239 | A | | 11/1967 | Heijnis |
| 3,409,946 | A | | 11/1968 | Whitehurst |
| 3,413,982 | A | | 12/1968 | Sublett et al. |
| 3,424,172 | A | | 1/1969 | Neurath |
| 3,429,010 | A | | 2/1969 | Fasaroli |
| 3,461,882 | A | | 8/1969 | Epstein et al. |
| 3,470,586 | A | | 10/1969 | Roberts |
| 3,485,120 | A | | 12/1969 | Keith |
| 3,571,870 | A | | 3/1971 | Dixon et al. |
| 3,636,591 | A | | 1/1972 | Herubel |
| 3,658,626 | A | | 4/1972 | Berger et al. |
| 3,813,740 | A | | 6/1974 | Heijnis |
| 3,904,577 | A | | 9/1975 | Buisson |
| 3,915,042 | A | | 10/1975 | Laird |
| 3,944,485 | A | | 3/1976 | Rembaum et al. |
| 4,004,330 | A | | 1/1977 | Stanley |
| 4,006,277 | A | | 2/1977 | Laird |
| 4,085,760 | A | | 4/1978 | Toyoshima et al. |
| 4,095,318 | A | | 6/1978 | Abbott et al. |
| 4,141,115 | A | | 2/1979 | Fourne et al. |
| 4,173,504 | A | | 11/1979 | Tomioka et al. |
| 4,192,041 | A | | 3/1980 | Sasaki et al. |
| 4,195,649 | A | | 4/1980 | Noguchi et al. |
| 4,237,274 | A | | 12/1980 | Leoni et al. |
| 4,252,766 | A | | 2/1981 | Baldini et al. |
| 4,261,373 | A | | 4/1981 | Tamaoki et al. |
| 4,268,666 | A | | 5/1981 | Baldini et al. |
| 4,281,671 | A | | 8/1981 | Bynre et al. |
| 4,388,256 | A | | 6/1983 | Ishida et al. |
| 4,489,461 | A | | 12/1984 | Hasegawa et al. |
| 4,535,028 | A | | 8/1985 | Yokogi et al. |
| 4,538,490 | A | | 9/1985 | Becker |
| 4,539,729 | A | | 9/1985 | Meile et al. |
| 4,551,887 | A | | 11/1985 | Uematsu |
| 4,570,312 | A | | 2/1986 | Whitener, Jr. |
| 4,581,886 | A | | 4/1986 | Coll-Tortosa |
| 4,669,151 | A | | 6/1987 | Krusche |
| 4,763,674 | A | | 8/1988 | Lelah et al. |
| 4,768,262 | A | | 9/1988 | Gunter |
| 4,811,745 | A | | 3/1989 | Cohen et al. |
| 4,831,691 | A | | 5/1989 | Hollingsworth et al. |
| 4,876,078 | A | | 10/1989 | Arakawa et al. |
| 4,925,602 | A | | 5/1990 | Hill et al. |
| 4,947,874 | A | | 8/1990 | Brooks et al. |
| 5,022,964 | A | * | 6/1991 | Crane ..... A24D 3/14 131/341 |
| 5,025,538 | A | | 6/1991 | Saleh |
| 5,225,277 | A | | 7/1993 | Takegawa et al. |
| 5,230,960 | A | | 7/1993 | Iizuka |
| 5,268,158 | A | | 12/1993 | Paul, Jr. |
| 5,271,419 | A | | 12/1993 | Arzonico et al. |
| 5,275,859 | A | | 1/1994 | Phillips et al. |
| 5,338,605 | A | | 8/1994 | Noland et al. |
| 5,387,285 | A | | 2/1995 | Rivers |
| 5,427,852 | A | * | 6/1995 | Teufel ..... A24D 3/068 139/331 |
| 5,441,689 | A | | 8/1995 | Laity |
| 5,446,005 | A | | 8/1995 | Endo |
| 5,453,144 | A | | 9/1995 | Kauffman et al. |
| 5,482,773 | A | | 1/1996 | Bair |
| 5,536,486 | A | | 7/1996 | Nagata et al. |
| 5,622,190 | A | | 4/1997 | Arterbery et al. |
| 5,709,227 | A | | 1/1998 | Arzonico et al. |
| 5,720,803 | A | | 2/1998 | Itoh et al. |
| 5,758,483 | A | | 6/1998 | Phillips et al. |
| 5,783,505 | A | | 7/1998 | Ducket et al. |
| 5,911,224 | A | | 6/1999 | Berger |
| 5,913,311 | A | | 6/1999 | Ito et al. |
| 5,947,126 | A | | 9/1999 | Wilson et al. |
| 5,970,988 | A | | 10/1999 | Buchanan et al. |
| 5,997,790 | A | | 12/1999 | Vos et al. |
| 6,062,228 | A | | 5/2000 | Loercks et al. |
| 6,076,346 | A | | 6/2000 | Nakayama et al. |
| 6,080,457 | A | | 6/2000 | Charlton et al. |
| 6,087,465 | A | | 7/2000 | Seppälä et al. |
| 6,344,239 | B1 | | 2/2002 | Asai et al. |
| 6,370,858 | B1 | | 4/2002 | Mori |
| 6,571,802 | B1 | | 6/2003 | Yamashita |
| 6,595,217 | B1 | | 7/2003 | Case et al. |
| 6,706,361 | B1 | | 3/2004 | Ecomony et al. |
| 6,739,344 | B2 | | 5/2004 | Yamashita |
| 6,984,631 | B2 | | 1/2006 | Aranishi et al. |
| 7,152,288 | B1 | | 12/2006 | Sanderson et al. |
| 7,223,376 | B2 | | 5/2007 | Panter et al. |
| 7,435,208 | B2 | | 10/2008 | Garthaffner |
| 7,484,511 | B2 | | 2/2009 | Jupe et al. |
| 8,177,938 | B2 | | 5/2012 | Sumnicht |
| 2003/0200973 | A1 | | 10/2003 | Xue et al. |
| 2003/0213496 | A1 | | 11/2003 | Wolff et al. |
| 2005/0011529 | A1 | | 1/2005 | Horn et al. |
| 2006/0201524 | A1 | | 9/2006 | Zhang et al. |
| 2006/0231113 | A1 | | 10/2006 | Newbery et al. |
| 2007/0143976 | A1 | | 6/2007 | Sommer |
| 2008/0295852 | A1 | | 12/2008 | Riepert et al. |
| 2009/0047857 | A1 | | 2/2009 | Chang et al. |
| 2009/0151738 | A1 | | 6/2009 | Robertson et al. |
| 2009/0288669 | A1 | | 11/2009 | Hutchens |
| 2009/0288672 | A1 | | 11/2009 | Hutchens |
| 2010/0294288 | A1 | | 11/2010 | Sampson et al. |
| 2011/0023900 | A1 | | 2/2011 | Clarke et al. |
| 2011/0036366 | A1 | | 2/2011 | Sebastian |
| 2011/0094526 | A1 | | 4/2011 | Marshall et al. |
| 2011/0244499 | A1 | | 10/2011 | Realff et al. |
| 2011/0247609 | A1 | | 10/2011 | Bansal et al. |
| 2012/0000477 | A1 | | 1/2012 | Sebastian et al. |
| 2012/0000479 | A1 | | 1/2012 | Sebastian et al. |
| 2012/0000480 | A1 | | 1/2012 | Sebastian et al. |
| 2012/0017925 | A1 | | 1/2012 | Sebastian et al. |
| 2012/0024304 | A1 | | 2/2012 | Sebastian |

FOREIGN PATENT DOCUMENTS

| | | |
|---|---|---|
| EP | 0 769 253 | 4/1997 |
| EP | 2 323 506 | 5/2011 |
| EP | 2 160 107 | 10/2012 |
| JP | S 53154225 | 12/1978 |
| WO | WO 95/24520 | 9/1995 |
| WO | WO 2009/000453 | 12/2008 |
| WO | WO 2009/093051 | 7/2009 |
| WO | WO 2011/048397 | 4/2011 |

OTHER PUBLICATIONS

Puls et al., "Degradation of Cellulose Acetate-Based Materials: A Review," *J Polym Environ*, 2011, pp. 152-165, vol. 19.

* cited by examiner

MIXED FIBER SLIVER FOR USE IN THE MANUFACTURE OF CIGARETTE FILTER ELEMENTS

CROSS-REFERENCE TO RELATED APPLICATIONS

The present application is a continuation of U.S. application Ser. No. 13/557,473, filed Jul. 25, 2012, which is incorporated by reference herein in its entirety.

FIELD OF THE DISCLOSURE

The present disclosure relates to products made or derived from tobacco or other smokable material that are intended for human consumption. In particular, the disclosure relates to filter elements for smoking articles such as cigarettes, and related methods and apparatuses for producing filter elements.

BACKGROUND

Popular smoking articles, such as cigarettes, may have a substantially cylindrical rod-shaped structure and may include a charge, roll or column of smokable material, such as shredded tobacco (e.g., in cut filler form), surrounded by a paper wrapper, thereby forming a so-called "smokable rod" or "tobacco rod." Normally, a cigarette has a cylindrical filter element aligned in an end-to-end relationship with the tobacco rod. Typically, a filter element comprises plasticized cellulose acetate tow circumscribed by a paper material known as "plug wrap." Typically, the filter element is attached to one end of the tobacco rod using a circumscribing wrapping material known as "tipping material." It also may be desirable to perforate the tipping material and plug wrap, in order to provide dilution of drawn mainstream smoke with ambient air. Descriptions of cigarettes and the various components thereof are set forth in Tobacco Production, Chemistry and Technology, Davis et al. (Eds.) (1999). A cigarette is employed by a smoker by lighting one end thereof and burning the tobacco rod. The smoker then receives mainstream smoke into his/her mouth by drawing on the opposite end (e.g., the filter end) of the cigarette.

After use, the discarded portion of the cigarette is primarily composed of the filter element, which typically consists of tightly-compacted and highly crimped cellulose acetate fibers bonded at their contact points and wrapped by the plug wrap and tipping material. The presence of the wrapping materials, the fiber-to-fiber bonding, and the compacted nature of conventional filter elements has a detrimental effect on the rate of degradation of cigarette filters in the environment. Unless the filter element is unwrapped and the fibers spread apart to increase exposure, biodegradation of the filter can take several years.

Cellulose is a known biodegradable fiber which is capable of aerobic and/or anaerobic degradation in a variety of environments. However, cellulose has traditionally not been used for the production of fibrous tow for filter elements, due in large part to the poor taste of cigarette smoke associated with cellulose-based filter elements as compared with traditional cellulose-acetate-based filter elements. It is believed that the traditionally-used cellulose acetate is advantageous in providing acetate groups that can interact with and remove certain undesirable phenolic compounds from the vapor phase of cigarette smoke. Cellulose does not have acetate groups on the fiber surface and it is believed that this may contribute to the poor taste associated with cellulose-based filters. Surface acetylation of cellulose and other types of fibers to address this issue has been proposed. See, for example, U.S. Pat. No. 4,085,760 to Toyoshima. However, there is no commercial process available for surface acetylation, which generally requires long reaction times and/or toxic chemicals.

Certain filter elements for cigarettes have been developed which contain materials that may promote biodegradation of filter elements following use. For example, certain additives have been noted (e.g., water soluble cellulose materials, water soluble fiber bonding agents, starch particles, photoactive pigments, and/or phosphoric acid) which can be added to filter materials to enhance degradability. See, for example, U.S. Pat. No. 5,913,311 to Ito et al.; U.S. Pat. No. 5,947,126 to Wilson et al.; U.S. Pat. No. 5,970,988 to Buchanan et al.; and U.S. Pat. No. 6,571,802 to Yamashita; and US Pat. Appl. Publ. Nos. 2009/0151735 to Robertson and 2011/0036366 to Sebastian. In some cases, conventional cellulose acetate filter material has been replaced with other materials, such as moisture disintegrative sheet materials, extruded starch materials, or polyvinyl alcohol. See U.S. Pat. No. 5,709,227 to Arzonico et al; U.S. Pat. No. 5,911,224 to Berger; U.S. Pat. No. 6,062,228 to Loercks et al.; and U.S. Pat. No. 6,595,217 to Case et al. It has also been suggested that the incorporation of slits into a filter element may enhance biodegradability, as described in U.S. Pat. No. 5,947,126 to Wilson et al. and U.S. Pat. No. 7,435,208 to Garthaffner. Biodegradability has also been proposed to be imparted by use of certain adhesives, such as described in U.S. Pat. No. 5,453,144 to Kauffman et al. and US Pat. Appl. Publ. 2012/0000477 to Sebastian et al. Another possible means for enhancing biodegradability is replacing the conventional cellulose acetate filter material with a core of a fibrous or particulate cellulose material coated with a cellulose ester, as described in U.S. Pat. No. 6,344,349 to Asai et al.

Further advancements in filter elements and apparatuses and methods for producing the same are desirable. Particularly, additional methods for enhancing the biodegradability of filter elements for preparing such filters having enhanced biodegradability are desirable.

SUMMARY OF THE DISCLOSURE

In one aspect, a method for forming a fibrous bundle suitable for use in a cigarette filter element is provided. Advantageously, the method may be such that it provides a filter element having enhanced biodegradability in comparison to traditional cellulose acetate tow-based filter elements, while retaining the desirable organoleptic properties associated with cellulose acetate filters.

In one embodiment, the invention provides a method for forming a fibrous bundle suitable for use in a filter element for a smoking article, the method comprising blending a first plurality of cellulose acetate staple fibers with a second plurality of staple fibers comprising a polymeric material different from the first plurality of staple fibers to give a fiber mixture; and carding the fiber mixture to provide a mixed fiber sliver having a total denier in the range of from about 20,000 denier to about 80,000 denier.

In another aspect, the invention provides a method for forming a filter element for a smoking article, the method receiving a mixed fiber sliver comprising a mixture of a first plurality of cellulose acetate staple fibers and a second plurality of staple fibers comprising a polymeric material different from the first plurality of staple fibers, the mixed fiber sliver having a total denier in the range of from about 20,000 denier to about 80,000 denier; and processing the mixed fiber sliver to provide a filter element suitable for incorporation into a smoking article.

In some embodiments, the mixed fiber sliver used in the above-noted methods has a total denier in the range of from about 30,000 denier to about 60,000 denier. The second plurality of staple fibers can, in some embodiments, comprise a degradable polymeric material, such as aliphatic polyesters, cellulose, regenerated cellulose, cellulose acetate with imbedded starch particles, cellulose coated with acetyl groups, polyvinyl alcohol, starch, aliphatic polyurethanes, polyesteramides, cis-polyisoprene, cis-polybutadiene, polyanhydrides, polybutylene succinate, and copolymers and blends thereof.

In some embodiments, the plurality of staple fibers comprising cellulose acetate and the second plurality of staple fibers comprising a material other than cellulose acetate are provided in a weight ratio of the first plurality of cellulose acetate staple fibers to the second plurality of staple fibers of about 25:75 to about 75:25, such as an embodiment wherein the two types of staple fibers are present in roughly equivalent amounts by weight. In some embodiments, the plurality of staple fibers comprising cellulose acetate and the plurality of staple fibers comprising a material other than cellulose acetate are in roughly equivalent lengths. The lengths of the staple fibers can vary and may be, for example, from about 2 to about 20 inches, from about 5 to about 15 inches. In some embodiments, the staple fibers of both types have lengths of about 7 inches or greater.

The method may, in some embodiments, include one or more additional steps, including, but not limited to, drafting the mixed fiber sliver, twisting or crimping the mixed fiber sliver, applying a plasticizer to the mixed fiber sliver, and/or strengthening the mixed fiber sliver by air entangling or by incorporation of a core yarn or textured yarn into the mixed fiber sliver. Further, in certain embodiments, the method further comprises incorporating the mixed fiber sliver into a filter element for a smoking article.

In another aspect of the invention is provided a filter element comprising a mixed fiber sliver comprising a mixture of a first plurality of cellulose acetate staple fibers and a second plurality of staple fibers comprising a polymeric material different from the first plurality of staple fibers, the mixed fiber sliver having a total denier in the range of from about 20,000 denier to about 80,000 denier. In certain embodiments, the filter element exhibits a degradation rate that is at least about 50% faster than that of a traditional cellulose acetate filter element. In a further embodiment is provided a cigarette, comprising a rod of smokable material and a filter element comprising a mixed fiber sliver as described herein attached to the rod. Other aspects and advantages of the present invention will become apparent from the following.

BRIEF DESCRIPTION OF THE DRAWINGS

In order to assist the understanding of embodiments of the disclosure, reference will now be made to the appended drawings, which are not necessarily drawn to scale. The drawings are exemplary only, and should not be construed as limiting the disclosure.

DETAILED DESCRIPTION OF THE PREFERRED EMBODIMENTS

Figure 1:
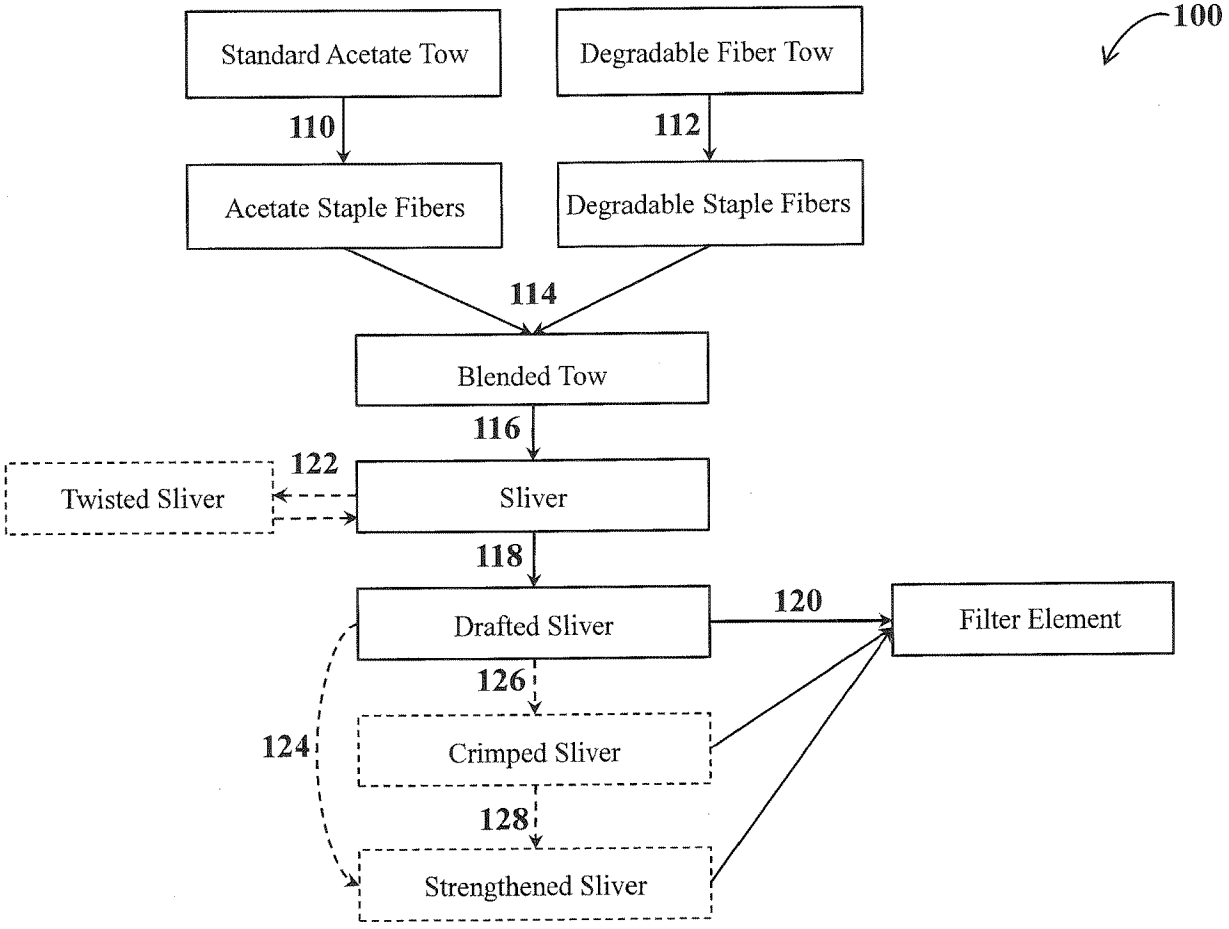
FIG. 1 is a block diagram of a method for forming a cigarette filter element according to an example embodiment.

The present disclosure now will be described more fully hereinafter with reference to the accompanying drawings. The disclosure may be embodied in many different forms and should not be construed as limited to the embodiments set forth herein; rather, these embodiments are provided so that this disclosure will satisfy applicable legal requirements. Like numbers refer to like elements throughout. As used in this specification and the claims, the singular forms "a," "an," and "the" include plural references unless the context clearly dictates otherwise.

As described herein, embodiments of the disclosure relate to products comprising staple fibers, configured for use in the manufacture of cigarette filter elements and methods and apparatuses for the production thereof. By way of comparison, in the traditional production of cigarettes, one tow fiber is typically employed to form the filter element. A tow fiber, as used herein, refers to a substantially untwisted bundle of two or more substantially continuous filaments of a fiber. The material composition of the fibers forming the tow fiber may vary depending on the desired characteristics of the filter element to be produced from the tow fiber. For example, the fibers forming the tow fiber may comprise cellulose acetate, which may be employed for desirable taste and filtering characteristics associated therewith.

Accordingly, provided herein are methods and apparatuses for improved filter elements that incorporate two or more fibers that may exhibit differing characteristics. In particular, in certain embodiments, the present disclosure provides a means by which two or more dissimilar fibers can be incorporated within a filter element by providing the two or more fibers in cut staple fiber form, blending the cut staple fibers, forming the cut staple fibers into a sliver, and incorporating the sliver into a filter element for a smoking article.

In some embodiments, the two or more dissimilar fibers can be characterized as having different filtration properties or exhibiting different levels of biodegradability. By combining such fibers in the same filter element using the apparatuses, systems, and methods of the present disclosure, the overall level of biodegradability of the filter element can be adjusted to a desired level or the filtration efficiency with respect to specific solid or gaseous components of mainstream smoke can be adjusted as desired. Examples of combinations of fiber types exhibiting different filtration characteristics can be found, for example, in US Pat. Appl. Pub. No. 2012/0024304 to Sebastian et al., which is incorporated by reference herein in its entirety. In some embodiments, by combining different fiber types in the same filter element using the apparatuses, systems, and methods of the present disclosure, the filter element incorporated within a cigarette can achieve the desired function (e.g., desired level of biodegradability and/or filtration efficiency) while providing the user with acceptable taste characteristics typically associated with traditional cellulose acetate-based filter elements.

In this regard, FIG. 1 illustrates an example embodiment of a system 100 of operations configured to produce filter elements, with operations performed by the system illustrated schematically. In particular, the system 100 is configured to receive two or more fibrous tow types, cut the fibrous tows into staple fibers, blend the staple fibers, and form a blended "sliver" from the two or more types of cut staple fibers. A sliver is a bundle of fibers aligned such that they are generally relatively parallel to one another (and thus has been subjected to a carding process). The fibers within the bundle are typically loosely assembled. The sliver may be employed in the formation of filter elements, which may then be incorporated into cigarettes or other smoking articles. Although the system 100 is illustrated as including sequential operations, it is to be understood that the operations need not necessarily occur in the order shown. Further, the system may include fewer or a greater number of operations in some embodiments.

The system 100 of FIG. 1 may be configured to receive inputs of two (or more) fibrous tows. Fibrous tows are well known in the art and are understood to be groupings of extruded filaments that are longitudinally aligned in a substantially parallel orientation. The tows can be prepared by various techniques known in the art and can, in certain embodiments, be stored in bales and withdrawn therefrom for use according to the present invention. In preferred embodiments, the fibrous tow inputs can be raw and/or untreated, meaning that they can be unbonded/unplasticized, and can be crimped or uncrimped prior to use.

Generally, one of the fiber inputs comprises standard cellulose acetate tow and one of the fiber inputs comprises a different type of tow. For example, in certain embodiments, the second fiber input comprises a degradable (e.g., biodegradable) fiber-based tow. The term "biodegradable" as used in reference to a degradable polymer refers to a polymer that degrades under aerobic and/or anaerobic conditions in the presence of bacteria, fungi, algae, and/or other microorganisms into carbon dioxide/methane, water and biomass, although materials containing heteroatoms can also yield other products such as ammonia or sulfur dioxide. "Biomass" generally refers to the portion of the metabolized materials incorporated into the cellular structure of the organisms present or converted to humus fractions indistinguishable from material of biological origin.

Biodegradability can be measured, for example, by placing a sample in environmental conditions expected to lead to decomposition, such as placing a sample in water, a microbe-containing solution, a compost material, or soil. The degree of degradation can be characterized by weight loss of the sample over a given period of exposure to the environmental conditions. Exemplary rates of degradation for certain filter element embodiments of the invention include a weight loss of at least about 20% after burial in soil for 60 days or a weight loss of at least about 30% after 15 days of exposure to a typical municipal composter. However, rates of biodegradation can vary widely depending on the type of degradable particles used, the remaining composition of the filter element, and the environmental conditions associated with the degradation test. U.S. Pat. No. 5,970,988 to Buchanan et al. and U.S. Pat. No. 6,571,802 to Yamashita provide exemplary test conditions for degradation testing. The degradability of a plastic material also may be determined using one or more of the following ASTM test methods: D5338, D5526, D5988, and D6400.

Exemplary biodegradable materials that can be used in a fibrous form in the present invention include aliphatic polyesters, cellulose, regenerated cellulose, cellulose acetate fibers with imbedded starch particles, polyvinyl alcohol, starch, aliphatic polyurethanes, polyesteramides, cis-polyisoprene, cis-polybutadiene, polyanhydrides, polybutylene succinate, and copolymers and blends thereof. Additional examples of biodegradable materials include thermoplastic cellulose, available from Toray Industries, Inc. of Japan and described in U.S. Pat. No. 6,984,631 to Aranishi et al., which is incorporated by reference herein, and thermoplastic polyesters such as Ecoflex® aliphatic-aromatic copolyester materials available from BASF Corporation or poly(ester urethane) polymers described in U.S. Pat. No. 6,087,465 to Seppala et al., which is incorporated by reference herein in its entirety. Any of these biodegradable fibers can further include a cellulose acetate coating on the outer surface thereof.

Exemplary aliphatic polyesters advantageously used in the present invention have the structure —[C(O)—R—O]$_n$—, wherein n is an integer representing the number of monomer units in the polymer chain and R is an aliphatic hydrocarbon, preferably a C1-C10 alkylene, more preferably a C1-C6 alkylene (e.g., methylene, ethylene, propylene, isopropylene, butylene, isobutylene, and the like), wherein the alkylene group can be a straight chain or branched. Exemplary aliphatic polyesters include polyglycolic acid (PGA), polylactic acid (PLA) (e.g., poly(L-lactic acid) or poly(DL-lactic acid)), polyhydroxyalkanoates (PHAs) such as polyhydroxypropionate, polyhydroxyvalerate, polyhydroxybutyrate, polyhydroxyhexanoate, and polyhydroxyoctanoate, polycaprolactone (PCL), polybutylene succinate, polybutylene succinate adipate, and copolymers thereof (e.g., polyhydroxybutyrate-co-hydroxyvalerate (PHBV)).

Various other degradable materials suitable for use in the present invention are set forth, for example, in US Pat. Appl. Pub. Nos. 2009/0288669 to Hutchens, 2011/0036366 to Sebastian; 2012/0000479 to Sebastian et al, 2012/0024304 to Sebastian, and U.S. patent application Ser. No. 13/194,063 to Sebastian et al., filed Jul. 29, 2011, all of which are incorporated by reference herein.

In preferred embodiments, the biodegradable fibrous tow input comprises cellulose (e.g., rayon). Cellulose can be natural or processed. In certain embodiments, cellulose as used herein may refer to regenerated cellulose fibers. Regenerated cellulose fibers are typically prepared by extracting non-cellulosic compounds from wood, contacting the extracted wood with caustic soda, followed by carbon disulfide and then by sodium hydroxide, giving a viscous solution. The solution is subsequently forced through spinneret heads to create viscous threads to give regenerated fibers. Exemplary methods for the preparation of regenerated cellulose are provided in U.S. Pat. No. 4,237,274 to Leoni et al; U.S. Pat. No. 4,268,666 to Baldini et al; U.S. Pat. No. 4,252,766 to Baldini et al.; U.S. Pat. No. 4,388,256 to Ishida et al.; U.S. Pat. No. 4,535,028 to Yokogi et al.; U.S. Pat. No. 5,441,689 to Laity; U.S. Pat. No. 5,997,790 to Vos et al.; and U.S. Pat. No. 8,177,938 to Sumnicht, which are incorporated herein by reference. Various suppliers of regenerated cellulose are known, including Lenzing AG (Austria). For use in the present invention, cellulose fibers in certain embodiments are advantageously treated to provide a secondary finish that imparts acetyl functionality to the fiber surface. Coated cellulose fibers can be provided, for example, using methods as outlined in US Pat. Appl. Pub. Nos. 2012/0017925; 2012/0000480; and 2012/0000479, all to Sebastian et al, which are incorporated herein by reference. The combination of cellulose acetate and cellulose fibers is particularly beneficial as the biodegradation rate of cellulose acetate and cellulose fibers has been shown to be greater than the sum of individual fiber degradation rates (i.e., the mixture biodegrades in a synergistic fashion). See U.S. Pat. No. 5,783,505 to Ducket et al., which is incorporated herein by reference.

In some embodiments, one of the fiber inputs comprises standard cellulose acetate tow and one of the fiber inputs comprises carbon fibers, ion exchange fibers, and/or catalytic fibers. Carbon fibers can be described as fibers obtained by the controlled pyrolysis of a precursor fiber. Sources of carbon fibers include Toray Industries, Toho Tenax, Mitsubishi, Sumitomo Corporation, Hexcel Corp., Cytec Industries, Zoltek Companies, and SGL Group. Exemplary commercially available carbon fibers include ACF-1603-15 and ACF-1603-20 available from American Kynol, Inc. Examples of starting materials, methods of preparing carbon-containing fibers, and types of carbon-containing fibers are disclosed in U.S. Pat. No. 3,319,629 to Chamberlain; U.S. Pat. No. 3,413,982 to Sublett et al.; U.S. Pat. No. 3,904,577 to Buisson; U.S. Pat. No. 4,281,671 to Bynre et al.; U.S. Pat. No. 4,876,078 to Arakawa et al.; U.S. Pat. No. 4,947,874 to Brooks et al.; U.S. Pat. No. 5,230,960 to Iizuka; U.S. Pat. No. 5,268,158 to Paul, Jr.; U.S. Pat. No. 5,338,605 to Noland et al.; U.S. Pat. No. 5,446,005 to Endo; U.S. Pat. No. 5,482,773 to Bair; U.S. Pat. No. 5,536,486 to Nagata et al.; U.S. Pat. No. 5,622,190 to Arterbery et al.; and U.S. Pat. No. 7,223,376 to Panter et al.; and U.S. Pat. Publication Nos. 2003/0200973 to Xue et al.; 2006/0201524 to Zhang et al. 2006/0231113 to Newbery et al., and 2009/0288672 to Hutchens, all of which are incorporated herein by reference.

Ion exchange fibers are fibers capable of ion exchange with gas phase components of mainstream smoke from a smoking article. Such fibers are typically constructed by imbedding particles of an ion exchange material into the fiber structure or coating the fiber with an ion exchange resin. The amount of ion exchange material present in the fiber can vary, but is typically about 10 to about 50 percent by weight, based on the total weight of the ion exchange fiber, more often about 20 to about 40 percent by weight. Exemplary ion exchange fibers are described in U.S. Pat. No. 3,944,485 to Rembaum et al. and U.S. Pat. No. 6,706,361 to Economy et al, both of which are incorporated by reference herein. Ion exchange fibers are commercially available, for example, from Fiban of Belarus and Kelheim Fibers GmbH of Germany. Exemplary products from Fiban include FIBAN A-1 (monofunctional strong base fiber with $—N^+(CH_3)_3Cl^-$ functional group), FIBAN AK-22-1 (polyfunctional fiber with ≡NH, ═NH, and —COOH functional groups), FIBAN K-1 (monofunctional strong acid fiber with $—SO^{3-}H^+$ functional group), FIBAN K-3 (polyfunctional fiber with —COOH, $—NH_2$, and ═NH functional groups), FIBAN K-4 (monofunctional weak acid fiber with —COOH functional group), FIBAN X-1 (iminodiacetic fiber) FIBAN K-1-1 (strong acid fiber similar to FIBAN K-1 modified by potassium-cobalt-ferrocyanide), FIBAN A-5 (polyfunctional fiber with $—N(CH_3)_2$, ═NH, and —COOH functional groups), FIBAN A-6 and A-7 (polyfunctional fiber with strong and weak base amine groups), FIBAN AK-22B (polyfunctional fiber similar to FIBAN K-3), and FIBAN S (monofunctional fiber with $[FeOH]^{2+}$ functional group). One exemplary product from Kelheim Fibers is the Poseidon Fiber.

Catalytic fibers are fibers capable of catalyzing the reaction of one or more gas phase components of mainstream smoke, thereby reducing or eliminating the presence of the gas phase component in the smoke drawn through the filter element. Exemplary catalytic fibers catalyze oxidation of one or more gaseous species present in mainstream smoke, such as carbon monoxide, nitrogen oxides, hydrogen cyanide, catechol, hydroquinone, or certain phenols. The oxidation catalyst used in the invention is typically a catalytic metal compound (e.g., metal oxides such as iron oxides, copper oxide, zinc oxide, and cerium oxide) that oxidizes one or more gaseous species of mainstream smoke. Exemplary catalytic metal compounds are described in U.S. Pat. No. 4,182,348 to Seehofer et al.; U.S. Pat. No. 4,317,460 to Dale et al.; U.S. Pat. No. 4,956,330 to Elliott et al.; U.S. Pat. No. 5,050,621 to Creighton et al.; U.S. Pat. No. 5,258,340 to Augustine et al.; U.S. Pat. No. 6,503,475 to McCormick; U.S. Pat. No. 6,503,475 to McCormick, U.S. Pat. No. 7,011,096 to Li et al.; U.S. Pat. No. 7,152,609 to Li et al.; U.S. Pat. No. 7,165,553 to Luan et al.; U.S. Pat. No. 7,228,862 to Hajaligol et al.; U.S. Pat. No. 7,509,961 to Saoud et al.; U.S. Pat. No. 7,549,427 to Dellinger et al.; U.S. Pat. No. 7,560,410 to Pillai et al.; and U.S. Pat. No. 7,566,681 to Bock et al.; and US Pat. Publication Nos. 2002/0167118 to Billiet et al.; 2002/0172826 to Yadav et al.; 2002/0194958 to Lee et al.; 2002/014453 to Lilly Jr., et al.; 2003/0000538 to Bereman et al.; 2005/0274390 to Banerjee et al.; 2007/0215168 to Banerjee et al.; 2007/0251658 to Gedevanishvili et al.; 2010/0065075 to Banerjee et al.; 2010/0125039 to Banerjee et al.; and 2010/0122708 to Sears et al., all of which are incorporated by reference herein in their entirety. Catalytic fibers can be constructed by, for example, imbedding particles of a catalytic material into the fiber structure or coating the fiber with a catalytic material, such as metal oxide particles. The amount of catalytic material present in the fiber can vary, but is typically about 10 to about 50 percent by weight, based on the total weight of the ion exchange fiber, more often about 20 to about 40 percent by weight. International Application No. WO 1993/005868, also incorporated herein by reference, describes the use of catalytic fibers formed by coating a surface-treated hopcalite material, which is a material including both copper oxides and manganese oxides available from the North Carolina Center for Research located in Morrisville, N.C., onto a fibrous support.

By way of example, cotton and/or regenerated cellulose having ion exchange groups introduced thereto may be employed, for example, as an ion-exchange fiber configured for vapor absorption. By way of further example, polylactic acid and/or polyhydroxyalkanoate may be employed as one or more fibers for improved biodegradability. Activated carbon fibers may also be employed for improved particle filtration and/or improved vapor absorption. The fibers may include any other fibers, which may be selected for improved biodegradability, improved particulate filtration, improved vapor absorption, and/or any other beneficial aspect associated with the fibers. For further examples, see the material compositions set forth in U.S. Pat. No. 3,424,172 to Neurath; U.S. Pat. No. 4,811,745 to Cohen et al.; U.S. Pat. No. 4,925,602 to Hill et al.; U.S. Pat. No. 5,225,277 to Takegawa et al.; and U.S. Pat. No. 5,271,419 to Arzonico et al.; each of which is incorporated herein by reference. Thereby, for example, the aspects of cellulose acetate that may be desirable (e.g., taste and filtration) may be retained while offering other functionality (e.g., improved biodegradability, improved particulate filtration, and/or improved vapor absorption).

The fiber tow inputs can have various physical properties. For example, the fiber tow inputs can have any total denier (i.e., weight in grams of a 9000 meter length of uncrimped tow). According to the present invention, the total denier of the tow input material is not critical, as the tow will be cut as desired. This aspect of the invention is particularly beneficial as certain materials (e.g., regenerated cellulose tow) are not widely available in typical required ranges for filter element production equipment. Exemplary total denier values for fiber tow inputs can vary depending on the particular input; for example, cellulose acetate tow can be commonly found with a total denier of from about 10,000 to about 100,000 (e.g., about 35,000) and cellulose tow is commonly found in much larger sizes (e.g., greater than about 80,000 or greater than about 100,000 denier).

Other characteristics of the fiber tow inputs include the denier of individual fibers thereof (denier per filament, i.e., "dpf"). Denier per filament is a measurement of the weight per unit length of the individual filaments of the fibers and can be manipulated to achieve a desired pressure drop across the filter element produced from the fibers. An exemplary dpf range for the filaments comprising the fibrous tow inputs may be about 1 to about 10 where denier is expressed in units of grams/9000 meters, although larger and smaller filaments can be used without departing from the invention. The shapes of the individual filament cross-sections can also vary and may include, but are not limited to, multilobal (e.g., exhibiting a shape such as an "X," "Y," "H," "I," or "C" shape), rectangular, circular, or oblong.

The relative amounts of each tow type utilized according to the methods of the invention can vary. For example, the inputs can be in roughly equal proportions by weight, giving a final product comprising about 1:1 cellulose acetate material: degradable material. In some embodiments, the inputs can be different, such that greater than 50% of the input comprises cellulose acetate material or such that greater than 50% of the input comprises degradable material. For example, the weight ratio of cellulose acetate input to degradable input can be from about 1:99 to about 99:1, and preferably from about 25:75 to 75:25. In certain embodiments, it can be desirable to maximize the degradable input so as to maximize the degradability of the resulting product. However, maximizing the degradable input may, in certain embodiments, hinder the ability to plasticize the resulting blended sliver (e.g., with triacetin). In such embodiments, therefore, a certain level of cellulose acetate is advantageously maintained to ensure sufficient plasticization.

As illustrated in FIG. 1, the standard cellulose acetate tow and the degradable tow are each cut into a multiplicity of staple fibers via steps 110 and 112, respectively. The cutting can be accomplished by various means. In some embodiments, the staple fibers are cut using a chopper/cutter, rotary cutter, or guillotine cutter or by stretch breaking. Tow cutting/breaking equipment is known as disclosed for example, in U.S. Pat. No. 3,485,120 to Keith; U.S. Pat. No. 3,658,626 to Berger et al.; U.S. Pat. No. 3,915,042 to Laird; U.S. Pat. No. 4,006,277 to Laird; U.S. Pat. No. 4,141,115 to Fourne et al.; U.S. Pat. No. 4,192,041 to Sasaki et al.; and U.S. Pat. No. 4,538,490 to Becker and US Pat Appl Publ No. 2009/0047857 to Chang et al., which are incorporated herein by reference. Exemplary commercially available equipment (e.g., tow cutter/chopper) is available, for example, from DM&E (Shelby, N.C.) and Lenzing Technik (Lenzing, Austria). In certain embodiments, the lengths of the staple fibers produced depend on the relationship between the speed of the cutter and the rate at which the tow is fed into the cutter. Accordingly, longer or shorter staple fibers can be provided in some embodiments by modifying the feed rate into the cutter. The lengths of the staple fibers produced via this step can vary and may be, for example, from about 2 to about 20 inches. In some embodiments, the staple fibers are from about 5 to about 15 inches, such as from about 7 to about 10 inches. The lengths of the staple fibers are preferably toward the higher end of these ranges, as longer staple fibers may endow the sliver produced therefrom with enhanced physical properties (e.g., increased strength). Accordingly, in some embodiments, staple fibers are about 5 inches or greater, about 7 inches or greater, or about 10 inches or greater. The range of staple fiber lengths produced according to this step can vary, but preferably, the staple fiber lengths are substantially uniform.

The cellulose acetate staple fibers and degradable staple fibers are blended in step 114 to give a blended fiber material. Various methods and equipment can be used to blend the staple fibers. Staple fibers can be hand blended and/or blended within various types of blending equipment (e.g., pickers, such as those manufactured by C. J. Sargent & Son (now part of Buhler Aeroglide Corporation, Cary, N.C.) and Davis & Furber Machine Company (originally in MA)). Advantageously, an intimate blend having a statistically random mixture of the two or more staple fiber types is produced.

The blend can subsequently be formed into a sliver in step 116 by carding. Carding generally is a mechanical process that separates fibers, removes tangles between fibers and aligns individual fibers such that they are more or less parallel to each other. It may also provide additional blending of the two or more components. Various carders are known, including but not limited to, drum carders, cottage carders, and industrial/commercial carders. Although carding can be done by hand, it is preferable to use a carding machine for use in the present invention. The carding system can comprise a roller top carding system or a flat top carding system. Carding units are available, for example, from Hergeth (Aachen, Germany—e.g., roller-doffed, fine air-doffed, and coarse air-doffed cards) and N. Schlumberger (Guebwiller Cedex, France—e.g., CA7 and CA6 models). Additional information and means by which carding can be accomplished are provided, for example, in U.S. Pat. No. 2,936,495 to Taine et al.; U.S. Pat. No. 3,249,967 to Varga; U.S. Pat. No. 3,470,586 to Roberts; U.S. Pat. No. 4,669,151 to Krusche; and U.S. Pat. No. 4,831,691 to Hollingsworth et al., which are incorporated herein by reference.

In some embodiments, an optional step 122 of twisting is conducted following the carding step. The sliver can optionally be twisted, which may add additional strength to the sliver. Twisting machinery is known and commercially available, for example, Volkmann and Allma twisting machines from Oerlikon Saurer (Kempten/Krefeld, Germany); and Gemini and Cosmos twisting machines from Savio Macchine (Milano, Italy). Other machinery and methods of use thereof is described, for example, in U.S. Pat. No. 4,581,886 to Coll-Tortosa; U.S. Pat. No. 5,758,483 to Phillips et al; and U.S. Pat. No. 6,076,346 to Nakayama et al., which are incorporated herein by reference. The degree of twist optionally imparted to the sliver can vary, but is generally sufficient to provide some degree of additional strength to the sliver. It is noted that too much twist may negatively impact the mechanical filtration ability of the final processed filter.

Slivers (which may optionally be twisted or otherwise strengthened) are then generally further straightened and stretched into a drawn sliver according to the invention via step 118 in a "drawing" or "drafting" process. The drafting process generally results in reducing the weight/yard of a sliver and increasing its length. A single sliver can be drawn or multiple slivers can be combined into one strand, which is drawn as a single strand. During this step, the fibers within the sliver may be straightened, aligned, the sliver may be made more uniform in size, and/or the blending of the component fibers can be enhanced. Generally, after carding, the sliver is passed into a drawframe, where it passes between at least one pair of rollers. Exemplary drafting machinery is described for example, in U.S. Pat. No. 2,175,107 to Casablancas; U.S. Pat. No. 2,782,112 to Berker; U.S.

Pat. No. 3,409,946 to Whitehurst; U.S. Pat. No. 3,429,010 to Fusaroli; U.S. Pat. No. 3,636,591 to Herubel; U.S. Pat. No. 4,489,461 to Toyoda; U.S. Pat. No. 4,551,887 to Murata; U.S. Pat. No. 4,539,729 to Rieter; and U.S. Pat. No. 4,768,262 to Gunter, which are incorporated herein by reference. Commercial equipment is available, for example, from Fleissner GmbH (Egelsbach, Germany—Tow Drawing Unit) and Zhangjiagang Yonxing Machinery Co., Ltd. (China—Drafter Units).

The drafting step generally provides the sliver in the desired size for incorporation within the filter element of a cigarette. Therefore, the drafting step typically results in modification of the overall denier of the mixed sliver. The desired denier can be modified by adjusting the feed rate into and/or through the drafting machine. According to the present invention, various total denier ranges can be provided; however, a total denier range of from about 20,000 denier to about 80,000 denier, more typically from about 30,000 denier to about 60,000 denier, is particularly desirable.

The drafted sliver can optionally be crimped, illustrated as step 126 in FIG. 1, following the carding or drafting step. "Crimp" is texture or waviness of individual fibers or the sliver as a whole. Crimp frequency, which is reported in crimps per inch (cpi), is an indirect measure of the bulk of the material. In some embodiments, crimping can generally involves passing the sliver through rollers and into a "stuffing box" or "stuffer box," wherein friction generates pressure, causing the fibers to buckle. Various crimp levels can be provided. For example, in some embodiments, the crimp level can be from about 10 to about 30 crimps per inch, e.g., about 15 to about 26 crimps per inch.

Various equipment is known for such purposes, such as that provided for example in U.S. Pat. No. 3,353,239 to Heijinis; U.S. Pat. No. 3,571,870 to Dixon et al.; U.S. Pat. No. 3,813,740 to Heijinis; U.S. Pat. No. 4,004,330 to Stanley; U.S. Pat. No. 4,095,318 to Abbott et al.; U.S. Pat. No. 5,025,538 to Saleh; and U.S. Pat. No. 7,152,288 to Sanderson et al., which are incorporated herein by reference. Commercial crimpers are available, for example, from DM&E Corporation (Shelby, N.C.); Fleissner GmbH (Egelsbach, Germany), and Oerlikon Neumag (Neumünster, Germany).

A sliver generally must have a certain degree of strength (e.g., tensile strength and/or tenacity) to be capable of being subjected to the subsequent processing steps traditionally employed for the production of cigarette filters. For example, in some embodiments, a breaking strength of at least about 15 pounds is required. In some cases, the sliver prepared as described above, which can be in crimped or uncrimped form, inherently has sufficient strength such that it can be directly subjected to step 120, incorporation into a filter element.

However, in certain embodiments, the strength of the sliver is insufficient to be directly incorporated into a filter element using methods generally used in the art. For example, in certain embodiments, the breaking strength of a sliver (in undrafted form, or having been subjected to some degree of drafting) according to the invention is between about 0.5 and about 1.5 pounds (e.g., between about 200 g and about 600 g) load at maximum load, with a percent strain at maximum load of between about 20% and about 50%. In some embodiments, it may be possible to adapt the subsequent processing steps to accommodate a sliver input having low strength. For example, the sliver can, in some embodiments, have sufficient strength that it can be introduced into a machine for further processing at a very slow feed rate to ensure that the sliver is not undesirably affected (e.g., broken or stretched) in the process.

It can, in certain embodiments, be advantageous to optimize one or more steps of the sliver production process and/or to add additional steps to the sliver production process in order to enhance the breaking strength of the sliver. Enhanced strength can, in some embodiments, allow the sliver to be directly processed on conventional filter making machinery. For example, in some embodiments, a breaking strength of between about 10 and about 20 lbs (about 4500 g to about 9100 g), such as at least about 10 lbs (about 4500 g) or at least about 15 lbs (about 6800 g) is desirable.

In some embodiments, as noted above, the sliver is strengthened prior to being incorporated into a filter element. In certain embodiments, the sliver can be strengthened directly (shown as step 124 of FIG. 1) and then incorporated into a filter element in step 120. In certain embodiments, the sliver is first crimped, as described above, and then strengthened via step 128 before being incorporated into a filter element in step 120. In some embodiments, the sliver may be strengthened such that it can be subjected to traditional processing (e.g., high speed processing) for the production of filter elements with little or no adaptations to accommodate the sliver. Numerous methods are known for strengthening such a material. In certain exemplary embodiments, the strengthening can comprise air entangling, core yarn insertion, textured yarn insertion, partial plasticization, or a combination thereof, although other methods that can function to strengthen the sliver are also intended to be encompassed herein.

Air entangling generally comprises using one or more air jets configured to direct air at the sliver. It is understood that the feed rate of the sliver into an air entangling system should be carefully controlled to ensure that a high quality entangled sliver is produced. Typically, a sliver that has been subjected to air entangling at step 128 exhibits enhanced entangling of the constituent fibers or filaments, with a plurality of bulked portions, separated in areas where the fibers or filaments are held together. For discussions of air entangling and descriptions of exemplary equipment used therefor, see, for example, U.S. Pat. No. 4,570,312 to Whitener, which is incorporated herein by reference.

Yarn insertion, including core yarn insertion and textured yarn insertion, generally comprises incorporating one or more yarns in the interior of the sliver or in the center of multiple slivers. The sliver can, in some embodiments, be wrapped around one or more yarns. In some embodiments, one or more yarns can be embedded within the sliver. The type of core yarn incorporated into the sliver at step 128 can vary and may be, for example, any of the types of fibers discussed herein or, for example, cotton yarn, elastic yarn, polymeric yarn, or cellulose acetate. Yarns can be textured, for example, via the methods described in U.S. patent application Ser. No. 13/241,399 to Sebastian et al, filed Sep. 23, 2011, which is incorporated herein by reference. For further discussions of exemplary configurations and methods for inserting yarn, see, for example, U.S. Pat. No. 7,484,522 to Jupe; U.S. Pat. No. 6,370,858 to Mori; and US Pat Appl. Pub. Nos. 2010/0294288 to Sampson et al. and 2009/0288672 to Hutchens et al., which are incorporated herein by reference.

Partial plasticization generally requires the addition of a plasticizer, i.e., a material that is capable of softening one or more components of the sliver. Plasticizer is optionally applied to the drafted sliver and may, in certain embodiments, be applied in traditional amounts using known techniques. For example, plasticizer application may involve applying (e.g., via spraying or wick application) a plasticizer to the sliver to produce a plasticized fiber product. Plasticizer application at operation 128 may, in some embodiments, be conducted for the purpose of ultimately bonding the filaments of the tow to one another to produce a relatively firm and rigid structure configured to not soften or collapse during smoking. Various types of plasticizers are known and can be employed according to the method disclosed herein. For example, glyceryl triacetate (triacetin), carbowax, diacetates, dipropionates, and dibutyrates of triethylene glycol, tetraethylene glycol, and pentaethylene glycol; levulinic acid esters, phthalic acid esters (e.g., dimethyl phthalate, dibutyl phthalate, dioctyl phthalate), phosphoric esters (e.g., tris(β-monochloroethyl)phosphate, tris(2,3-dichloropropyl)phosphate, and tris(2,3-dibromopropyl) phosphate), and combinations thereof. In one embodiment, the plasticizer may comprise triacetin and carbowax in a 1:1 ratio by weight. The total amount of plasticizer may be generally about 4 to about 20 percent by weight, preferably about 6 to about 12 percent by weight of the filter material. Other suitable materials or additives used in connection with the construction of the filter element will be readily apparent to those skilled in the art of cigarette filter design and manufacture. See, for example, U.S. Pat. No. 5,387,285 to Rivers, which is incorporated herein by reference.

The mixed fiber sliver, which can be optionally crimped and/or optionally strengthened, is incorporated within a filter element via step 120. This step can be accomplished by traditional techniques known in the art, such as those described, for example, in U.S. patent application Ser. No. 13/241,399 to Sebastian et al, filed Sep. 23, 2011, which is incorporated herein by reference. In certain embodiments, the mixed fiber sliver can be subjected to one or more rod making operations, which may include shaping of the drafted mixed fiber sliver. For example, the mixed fiber sliver may be compressed or otherwise shaped to form a continuous cylindrical rod shape.

The system used in the production of a filter according to the invention may differ from existing embodiments of systems configured to manufacture cigarettes in that the separation operations typically required in such systems (e.g., tow opening, crimp removal, and blooming) may not be necessary. This may be possible because the processes of the invention are, in certain embodiments, capable of combining the staple fibers in the manner described above such that the staple fibers are entangled (so as to provide a substantially evenly mixed distribution of the fibers) and sufficiently separated, allowing plasticizer to effectively penetrate the mixed fiber product. Accordingly, the system 100, in combination with the cigarette production methods described herein, may, in some embodiments, provide a means to combine two or more fibrous tow inputs, while avoiding the need for separation operations (e.g., tow opening, crimp removal, and blooming) following the mixing step 114, since the mixed fiber sliver produced may resemble bloomed tow.

The rod making operations may additionally include cutting the mixed fiber sliver into segments. In this regard, the sliver may be longitudinally subdivided into cylindrical shaped filter segments. In some embodiments the length of the filter segments may be selected based on a desired length of the filter element for a single cigarette. By way of further example, in another embodiment the filter segments may be cut to lengths which are equivalent to two times the length of the filter element for a single cigarette, and the filter segment may be cut in two at a later time. For example, the filter segment may connect two rods of tobacco, and the filter segment may be divided to form the filters for two cigarettes.

The measurements of filter segments depend on the particular application thereof, but typically filter segments for cigarettes may range in length from about 80 mm to about 140 mm, and from about 16 mm to about 27 mm in circumference. For example, a typical filter segment having a 100 mm length and a 24.53 mm circumference may exhibit a pressure drop of from about 200 mm to about 400 mm of water as determined at an airflow rate of 17.5 cubic centimeters per second (cc/sec.) using an encapsulated pressure drop tester, sold commercially as Model No. FTS-300 by Filtrona Corporation, Richmond, Va.

Certain embodiments of the system employing the production of a mixed fiber sliver of the present invention may provide benefits both in terms of allowing for combination of multiple fibers, and in terms of reducing the number of operations required to produce the filter elements. Further, the operations performed after production of the mixed fiber product may be substantially the same as those performed in traditional systems for producing smoking articles. Thus, existing cigarette production equipment may be utilized. For example, the plasticized fiber product may be subjected to one or more rod making operations in which the plasticized fiber product is wrapped with a plug wrap.

The mixed fiber sliver may be wrapped with the plug wrap such that each end of the filter material remains exposed. The plug wrap can vary. See, for example, U.S. Pat. No. 4,174,719 to Martin, which is incorporated herein by reference. Typically, the plug wrap is a porous or non-porous paper material. Suitable plug wrap materials are commercially available. Exemplary plug wrap papers ranging in porosity from about 1100 CORESTA units to about 26000 CORESTA units are available from Schweitzer-Maudit International as Porowrap 17-M1, 33-M1, 45-M1, 70-M9, 95-M9, 150-M4, 150-M9, 240M9S, 260-M4 and 260-M4T; and from Miquel-y-Costas as 22HP90 and 22HP150. Non-porous plug wrap materials typically exhibit porosities of less than about 40 CORESTA units, and often less than about 20 CORESTA units. Exemplary non-porous plug wrap papers are available from Olsany Facility (OP Paprina) of the Czech Republic as PW646; Wattenspapier of Austria as FY/33060; Miquel-y-Costas of Spain as 646; and Schweitzer-Mauduit International as MR650 and 180. Plug wrap paper can be coated, particularly on the surface that faces the mixed fiber sliver, with a layer of a film-forming material. Such a coating can be provided using a suitable polymeric film-forming agent (e.g., ethylcellulose, ethylcellulose mixed with calcium carbonate, nitrocellulose, nitrocellulose mixed with calcium carbonate, or a so-called lip release coating composition of the type commonly employed for cigarette manufacture). Alternatively, a plastic film (e.g., a polypropylene film) can be used as a plug wrap material. For example, non-porous polypropylene materials that are available as ZNA-20 and ZNA-25 from Treofan Germany GmbH & Co. KG can be employed as plug wrap materials.

If desired, so-called "non-wrapped acetate" filter segments may also be produced. Such segments are produced using the types of techniques generally set forth herein. However, rather than employing a plug wrap that circumscribes the longitudinally extending periphery of the filter material, a somewhat rigid rod is provided, for example, by applying steam to the shaped mixed fiber sliver. Techniques for commercially manufacturing non-wrapped acetate filter rods are possessed by Filtrona Corporation, Richmond, Va.

Accordingly, shaped, cut, and/or wrapped (or non-wrapped) filter elements may be produced by the rod making operation(s). The above-described system 100 may employ equipment capable of providing a mixed fiber product, while avoiding the need for separation operations (e.g., tow opening, crimp removal, and blooming) since the mixed fiber product produced by the carding apparatus may resemble bloomed tow. The system 100 may be further incorporated within a larger cigarette making operation. The cigarette making operations may include wrapping a supply of smokable material with a wrapping material to form a smokable rod.

Cigarette making operations used in combination with the filter preparation process 100 shown in FIG. 1 and described above may be conducted using a conventional automated cigarette rod making machine. Generally, automated cigarette making machines provide a formed continuous cigarette rod (or other smokable rod) that can be subdivided into formed smokable rods of desired lengths. The components and operation of conventional automated cigarette making machines will be readily apparent to those skilled in the art of cigarette making machinery design and operation. Exemplary cigarette rod making machines are of the type commercially available from Molins PLC or Hauni-Werke Korber & Co. KG. For example, cigarette rod making machines of the type known as MkX (commercially available from Molins PLC) or PROTOS (commercially available from Hauni-Werke Korber & Co. KG) can be employed. A description of a PROTOS cigarette making machine is provided in U.S. Pat. No. 4,474,190 to Brand, at col. 5, line 48 through col. 8, line 3, which is incorporated herein by reference. Types of equipment suitable for the manufacture of cigarettes also are set forth in U.S. Pat. No. 4,781,203 to La Hue; U.S. Pat. No. 4,844,100 to Holznagel; U.S. Pat. No. 5,131,416 to Gentry; U.S. Pat. No. 5,156,169 to Holmes et al.; U.S. Pat. No. 5,191,906 to Myracle, Jr. et al.; U.S. Pat. No. 6,647,870 to Blau et al.; U.S. Pat. No. 6,848,449 to Kitao et al.; and U.S. Pat. No. 6,904,917 to Kitao et al.; and US Pat. Appl. Pub. Nos. 2003/0145866 to Hartman; 2004/0129281 to Hancock et al.; 2005/0039764 to Barnes et al.; and 2005/0076929 to Fitzgerald et al.; each of which is incorporated herein by reference. Descriptions of the components and operation of several types of chimneys, tobacco filler supply equipment, suction conveyor systems and garniture systems are set forth in U.S. Pat. No. 3,288,147 to Molins et al.; U.S. Pat. No. 3,915,176 to Heitmann et al.; U.S. Pat. No. 4,291,713 to Frank; U.S. Pat. No. 4,574,816 to Rudszinat; U.S. Pat. No. 4,736,754 to Heitmann et al. U.S. Pat. No. 4,878,506 to Pinck et al.; U.S. Pat. No. 5,060,665 to Heitmann; U.S. Pat. No. 5,012,823 to Keritsis et al. and U.S. Pat. No. 6,360,751 to Fagg et al.; and US Pat. Appl. Pub. No. 2003/0136419 to Muller; each of which is incorporated herein by reference.

Filter elements produced in accordance with this disclosure may be incorporated within conventional cigarettes configured for combustion of a smokable material, and also within the types of cigarettes set forth in U.S. Pat. No. 4,756,318 to Clearman et al.; U.S. Pat. No. 4,714,082 to Banerjee et al.; U.S. Pat. No. 4,771,795 to White et al.; U.S. Pat. No. 4,793,365 to Sensabaugh et al.; U.S. Pat. No. 4,989,619 to Clearman et al.; U.S. Pat. No. 4,917,128 to Clearman et al.; U.S. Pat. No. 4,961,438 to Korte; U.S. Pat. No. 4,966,171 to Serrano et al.; U.S. Pat. No. 4,969,476 to Bale et al.; U.S. Pat. No. 4,991,606 to Serrano et al.; U.S. Pat. No. 5,020,548 to Farrier et al.; U.S. Pat. No. 5,027,836 to Shannon et al.; U.S. Pat. No. 5,033,483 to Clearman et al.; U.S. Pat. No. 5,040,551 to Schlatter et al.; U.S. Pat. No. 5,050,621 to Creighton et al.; U.S. Pat. No. 5,052,413 to Baker et al.; U.S. Pat. No. 5,065,776 to Lawson; U.S. Pat. No. 5,076,296 to Nystrom et al.; U.S. Pat. No. 5,076,297 to Farrier et al.; U.S. Pat. No. 5,099,861 to Clearman et al.; U.S. Pat. No. 5,105,835 to Drewett et al.; U.S. Pat. No. 5,105,837 to Barnes et al.; U.S. Pat. No. 5,115,820 to Hauser et al.; U.S. Pat. No. 5,148,821 to Best et al.; U.S. Pat. No. 5,159,940 to Hayward et al.; U.S. Pat. No. 5,178,167 to Riggs et al.; U.S. Pat. No. 5,183,062 to Clearman et al.; U.S. Pat. No. 5,211,684 to Shannon et al.; U.S. Pat. No. 5,240,014 to Deevi et al.; U.S. Pat. No. 5,240,016 to Nichols et al.; U.S. Pat. No. 5,345,955 to Clearman et al.; U.S. Pat. No. 5,396,911 to Casey, III et al.; U.S. Pat. No. 5,551,451 to Riggs et al.; U.S. Pat. No. 5,595,577 to Bensalem et al.; U.S. Pat. No. 5,727,571 to Meiring et al.; U.S. Pat. No. 5,819,751 to Barnes et al.; U.S. Pat. No. 6,089,857 to Matsuura et al.; U.S. Pat. No. 6,095,152 to Beven et al; and U.S. Pat. No. 6,578,584 to Beven; which are incorporated herein by reference. Still further, filter elements produced in accordance with the description provided above may be incorporated within the types of cigarettes that have been commercially marketed under the brand names "Premier" and "Eclipse" by R. J. Reynolds Tobacco Company. See, for example, those types of cigarettes described in Chemical and Biological Studies on New Cigarette Prototypes that Heat Instead of Burn Tobacco, R. J. Reynolds Tobacco Company Monograph (1988) and Inhalation Toxicology, 12:5, p. 1-58 (2000); which are incorporated herein by reference. Other examples of non-traditional cigarettes, commonly referred to as "e-cigarettes", which could incorporate a filter element of the present invention, include U.S. Pat. No. 7,726,320 to Robinson et al. and U.S. Pat. No. 8,079,371 to Robinson et al., and U.S. patent application Ser. No. 13/205,841 to Worm et al., filed on Aug. 9, 2011; Ser. No. 13/432,406 to Griffith Jr. et al., filed on Mar. 28, 2012; and Ser. No. 13/536,438 to Sebastian et al, filed on Jun. 28, 2012, all of which are incorporated by reference herein.

The smokable material employed in manufacture of the smokable rod can vary. For example, the smokable material can have the form of filler (e.g., such as tobacco cut filler). As used herein, the terms "filler" or "cut filler" are meant to include tobacco materials and other smokable materials which have a form suitable for use in the manufacture of smokable rods. As such, filler can include smokable materials which are blended and are in a form ready for cigarette manufacturer. The filler materials normally are employed in the form of strands or shreds as is common in conventional cigarette manufacture. For example, the cut filler material can be employed in the form of strands or shreds from sheet-like or "strip" materials which are cut into widths ranging from about 1/20 inch to about 1/60 inch, preferably from about 1/25 inch to about 1/35 inch. Generally, such strands or shreds have lengths which range from about 0.25 inch to about 3 inches.

Examples of suitable types of tobacco materials include flue-cured, Burley, Md. or Oriental tobaccos, rare or specialty tobaccos, and blends thereof. The tobacco material can be provided in the form of tobacco lamina; processed tobacco, processed tobacco stems such as cut-rolled or cut-puffed stems, reconstituted tobacco materials; or blends thereof. The smokable material or blend of smokable materials may consist essentially of tobacco filler material. Smokable materials can also be cased and top dressed as is conventionally performed during various stages of cigarette manufacture.

Typically, the smokable rod has a length which ranges from about 35 mm to about 85 mm, preferably about 40 to about 70 mm; and a circumference of about 17 mm to about 27 mm, preferably about 22.5 mm to about 25 mm. Short cigarette rods (i.e., having lengths from about 35 to about 50 mm) can be employed, particularly when smokable blends having a relatively high packing density are employed.

The wrapping material can vary, and typically is a cigarette wrapping material having a low air permeability value. For example, such wrapping materials can have air permeabilities of less than about 5 CORESTA units. Such wrapping materials include a cellulosic base web (e.g., provided from wood pulp and/or flax fibers) and inorganic filler material (e.g., calcium carbonate and/or magnesium hydroxide particles). A suitable wrapping material is a cigarette paper consisting essentially of calcium carbonate and flax. Particularly preferred wrapping materials include an amount of a polymeric film forming agent sufficient to provide a desirably low air permeability. Exemplary wrapping materials 164 are P-2540-80, P-2540-81, P-2540-82, P-2540-83, P-2540-84, and P-2831-102 available from Kimberly-Clark Corporation and TOD 03816, TOD 05504, TOD 05560 and TOD 05551 available from Ecusta Corporation.

The packing densities of the blend of smokable materials contained within the wrapping materials can vary. Typical packing densities for smokable rods may range from about 150 to about 300 mg/cm$^3$. Normally, packing densities of the smokable rods range from about 200 to about 280 mg/cm$^3$.

Further, the cigarette making operations may include attaching the mixed fiber sliver-based filter element to the smokable rod. For example, the filter element and a portion of the smokable rod may be circumscribed by a tipping material with an adhesive configured to bind to the filter element and the tobacco rod so as to couple the mixed fiber sliver-based filter element to an end of the tobacco rod.

Typically, the tipping material circumscribes the filter element and an adjacent region of the smokable rod such that the tipping material extends about 3 mm to about 6 mm along the length of the smokable rod. Typically, the tipping material is a conventional paper tipping material. The tipping material can have a permeability which can vary. For example, the tipping material can be essentially air impermeable, air permeable, or be treated (e.g., by mechanical or laser perforation techniques) so as to have a region of perforations, openings or vents thereby providing a means for providing air dilution to the cigarette. The total surface area of the perforations and the positioning of the perforations along the periphery of the cigarette can be varied in order to control the performance characteristics of the cigarette.

Accordingly, cigarettes (or other smokable articles) may be produced in accordance with the above-described example embodiments, or under various other embodiments of systems and methods for producing cigarettes. The cigarette making operations performed after production of the mixed fiber sliver as described above may, in certain embodiments, be substantially the same as those performed in traditional systems for producing smoking articles. Thus, existing cigarette production equipment may be utilized. It is noted that the system for forming cigarettes may also include other apparatuses and components that correspond with the operations discussed above.

Figure 2:
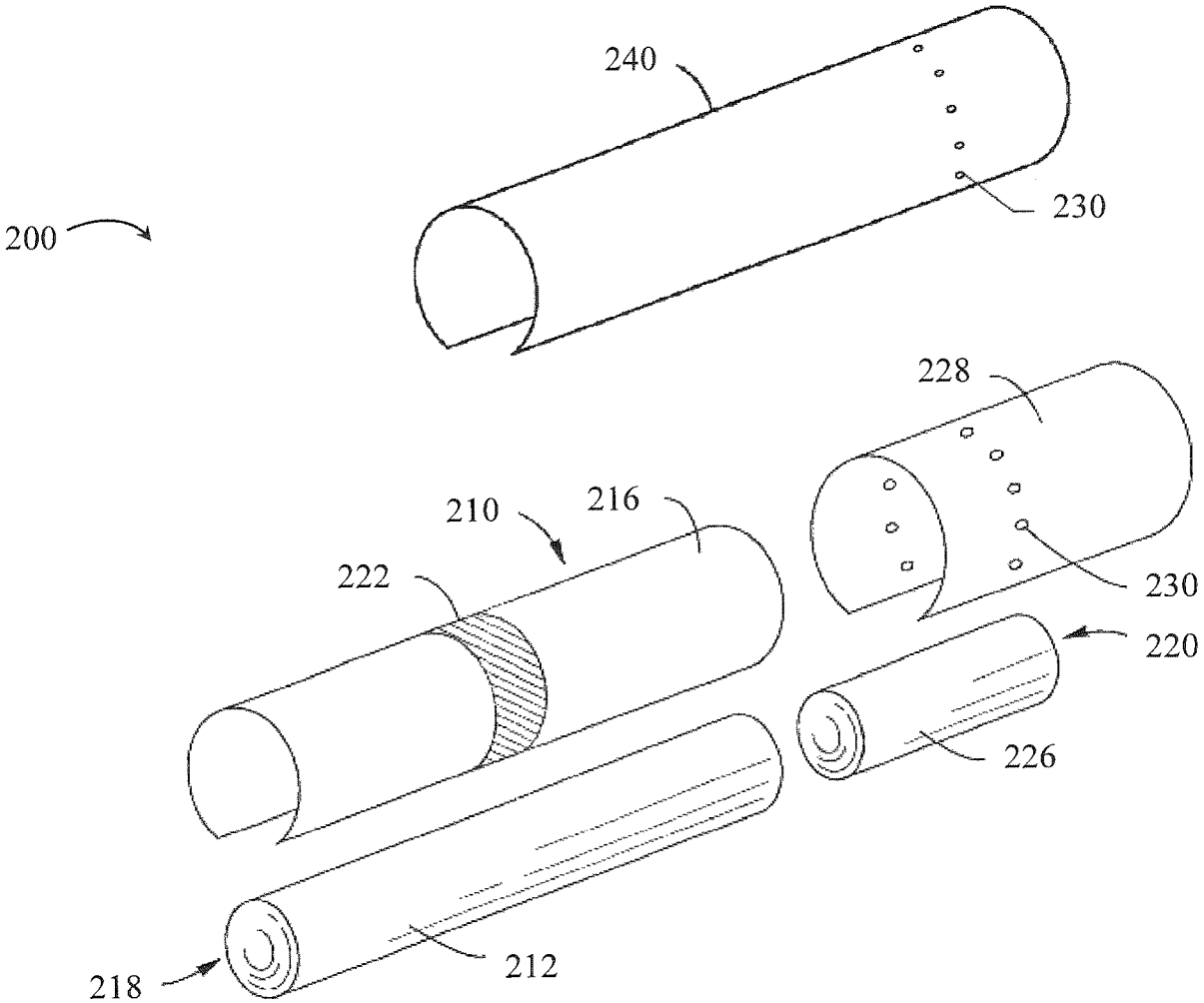
FIG. 2 is an exploded view of an example embodiment of a cigarette produced in accordance with the systems, methods, and apparatuses disclosed herein.

FIG. 2 illustrates an exploded view of a smoking article in the form of a cigarette 200 that may be produced by the apparatuses, systems, and methods disclosed herein. The cigarette 200 includes a generally cylindrical rod 212 of a charge or roll of smokable filler material contained in a circumscribing wrapping material 216. The rod 212 is conventionally referred to as a "tobacco rod." The ends of the tobacco rod 212 are open to expose the smokable filler material. The cigarette 200 is shown as having one optional band 222 (e.g., a printed coating including a film-forming agent, such as starch, ethylcellulose, or sodium alginate) applied to the wrapping material 216, and that band circumscribes the cigarette rod 212 in a direction transverse to the longitudinal axis of the cigarette 200. That is, the band 222 provides a cross-directional region relative to the longitudinal axis of the cigarette 200. The band 222 can be printed on the inner surface of the wrapping material 216 (i.e., facing the smokable filler material), or less preferably, on the outer surface of the wrapping material. Although the cigarette can possess a wrapping material having one optional band, the cigarette also can possess wrapping material having further optional spaced bands numbering two, three, or more.

At one end of the tobacco rod 212 is the lighting end 218, and at the mouth end 220 is positioned a mixed fiber sliver 226. The mixed fiber sliver 226 may be produced by the apparatuses, systems, and methods disclosed herein. The mixed sliver-based filter element 226 may have a generally cylindrical shape, and the diameter thereof may be essentially equal to the diameter of the tobacco rod 212. The mixed sliver-based filter 226 is circumscribed along its outer circumference or longitudinal periphery by a layer of outer plug wrap 228 to form a filter element. The filter element is positioned adjacent one end of the tobacco rod 212 such that the filter element and tobacco rod are axially aligned in an end-to-end relationship, preferably abutting one another. The ends of the filter element permit the passage of air and smoke therethrough.

A ventilated or air diluted smoking article can be provided with an optional air dilution means, such as a series of perforations 230, each of which extend through the tipping material 240 and plug wrap 228. The optional perforations 230 can be made by various techniques known to those of ordinary skill in the art, such as laser perforation techniques. Alternatively, so-called off-line air dilution techniques can be used (e.g., through the use of porous paper plug wrap and pre-perforated tipping material). For cigarettes that are air diluted or ventilated, the amount or degree of air dilution or ventilation can vary. Frequently, the amount of air dilution for an air diluted cigarette is greater than about 10 percent, generally is greater than about 20 percent, often is greater than about 30 percent, and sometimes is greater than about 40 percent. Typically, the upper level for air dilution for an air diluted cigarette is less than about 80 percent, and often is less than about 70 percent. As used herein, the term "air dilution" is the ratio (expressed as a percentage) of the volume of air drawn through the air dilution means to the total volume and air and smoke drawn through the cigarette and exiting the extreme mouth end portion of the cigarette. The plasticized fiber product 226 may be attached to the tobacco rod 212 using the tipping material 240 (e.g., essentially air impermeable tipping material), that circumscribes both the entire length of the filter element and an adjacent region of the tobacco rod 212. The inner surface of the tipping material 240 is fixedly secured to the outer surface of the plug wrap 228 and the outer surface of the wrapping material 216 of the tobacco rod, using a suitable adhesive; and hence, the filter element and the tobacco rod are connected to one another to form the cigarette 200.

EXPERIMENTAL

Example 1: Sliver Preparation a) Cutting

Acetate tow (40,000 denier, 3.0 dpf, supplied by Eastman Chemical Company) and rayon tow (1.5 million denier, 3.0 dpf, supplied by Lenzing) are separately cut into 7 inch staple fibers. The staple fibers are combined in a 1:1 ratio by hand blending.

b) Blending/Carding

The blended staple fibers are fed in 1 lb increments to a mini card feed apron and processed through a roller top card (Carolina Specialty TTC Mini Card). The resulting sliver is a 90-100 grain per yard sliver having a denier of about 57,000-64,000 denier.

The sliver at this point has a breaking strength of about 1 pound at maximum load. It is noted that this data is based on an unoptimized sliver. As described in the present application, there are numerous ways of increasing the strength, such as by twisting the sliver or by inserting a fiber along the length of the sliver. Further, the carding method can be optimized in certain embodiments to provide a sliver having a more manageable strength for use in traditional filter manufacturing equipment.

c) Pin Drafting

Four ends of the slivers are fed into a pin drafting unit (Warner & Swasey Co.), in a 243,000 denier total weight. The drafting unit is set to produce a 40,000 denier sliver. Although the drafting process successfully provided a drafted sliver, the product was not optimal. The drafted sliver was splotchy in certain areas (resulting from concentrated regions of acetate staple fibers), many of the acetate staple fibers were damaged, and the drafted sliver was overall difficult to process, relatively weak, and not homogeneous. Further optimization of the methods and materials, as provided by the present disclosure, are thus desirable to provide a drafted sliver having more desirable physical properties.

Example 2: Sheath-Core Production

As described above, one means for strengthening a sliver according to the invention is to insert another type of material so as to produce a product having a sheath-core type structure.

a) Insertion of Cellulose Acetate Yarn

A 10,000 denier textured cellulose acetate yarn is fed into the pin drafting unit so as to provide the yarn as a core within the drafted sliver. It is noted that, again, the drafting step was not optimized and thus, the same type of inhomogeneous product was produced and the sheath-core drafted sliver was uneven. The strengthened sliver exhibited a breaking strength of 16 lbs.

b) Insertion of Kevlar

A 24.0 denier/3 dpf, 100% spun KEVLAR™ (polyparaphenylene terephthalamide) is fed into the carding unit so as to provide the KEVLAR™ as a core within the sliver. The strengthened sliver exhibited a breaking strength of 10 pounds.

Many modifications and other embodiments of the disclosure will come to mind to one skilled in the art to which this disclosure pertains having the benefit of the teachings presented in the foregoing description; and it will be apparent to those skilled in the art that variations and modifications of the present disclosure can be made without departing from the scope or spirit of the disclosure. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A method for forming a fibrous bundle suitable for use in a filter element for a smoking article, the method comprising:

blending a first plurality of cellulose acetate staple fibers with a second plurality of staple fibers to give a fiber mixture, wherein the composition of the second plurality of staple fibers is polyhydroxyalkanoate (PHA) staple fibers, wherein the second plurality of staple fibers do not include a cellulose acetate coating on the outer surface thereof; and bonding the staple fibers of the fiber mixture to form a fibrous bundle.

2. The method of claim 1, wherein the polyhydroxyalkanoate staple fibers are selected from the group consisting of polyhydroxypropionate staple fibers, polyhydroxyvalerate staple fibers, polyhydroxybutyrate staple fibers, polyhydroxyhexanoate staple fibers, polyhydroxyoctanoate staple fibers, and combinations thereof.

3. The method of claim 1, wherein the bonding step comprises treating the fiber mixture with a plasticizer.

4. A method of providing a smoking article, comprising forming a fibrous bundle according to the method of claim 1, and incorporating the fibrous bundle into a filter element for a smoking article.

5. The method of claim 1, wherein the weight ratio of the first plurality of cellulose acetate staple fibers to the second plurality of staple fibers is about 25:75 to about 75:25.

6. The method of claim 1, further comprising blending a third plurality of staple fibers with the first plurality of cellulose acetate staple fibers and the second plurality of staple fibers to form the fiber mixture.

7. The method of claim 6, wherein the third plurality of staple fibers comprises a degradable polymeric material.

8. A filter element comprising a first plurality of cellulose acetate staple fibers blended with a second plurality of staple fibers to give a fiber mixture, wherein the composition of the second plurality of staple fibers is polyhydroxyalkanoate (PHA) staple fibers, wherein the second plurality of staple fibers do not include a cellulose acetate coating on the outer surface thereof.

9. The filter element of claim 8, wherein the polyhydroxyalkanoate staple fibers are selected from the group consisting of polyhydroxypropionate staple fibers, polyhydroxyvalerate staple fibers, polyhydroxybutyrate staple fibers, polyhydroxyhexanoate staple fibers, polyhydroxyoctanoate staple fibers, and combinations thereof.

10. The filter element of claim 8, wherein the weight ratio of the first plurality of cellulose acetate staple fibers to the second plurality of staple fibers is about 25:75 to about 75:25.

11. The filter element of claim 8, further comprising a plug wrap circumscribing the fiber mixture.

12. The filter element of claim 8, further comprising a third plurality of staple fibers blended with the first plurality of cellulose acetate staple fibers and the second plurality of staple fibers to form the fiber mixture.

13. The filter element of claim 12, wherein the third plurality of staple fibers comprises a biodegradable polymeric material.

14. The filter element of claim 8, wherein the filter element exhibits a degradation rate that is at least about 50% faster than that of a traditional cellulose acetate filter element.

15. A cigarette, comprising a rod of smokable material and a filter element according to claim 8 attached thereto.

* * * * *